US010699681B2

(12) United States Patent
Sikra

(10) Patent No.: US 10,699,681 B2
(45) Date of Patent: Jun. 30, 2020

(54) TRANSPORTABLE DRUM KIT

(71) Applicant: Drum Workshop, Inc., Oxnard, CA (US)

(72) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 16/255,544

(22) Filed: Jan. 23, 2019

(65) Prior Publication Data

US 2019/0228747 A1 Jul. 25, 2019

Related U.S. Application Data

(60) Provisional application No. 62/621,568, filed on Jan. 24, 2018.

(51) Int. Cl.
*G10D 13/02* (2006.01)

(52) U.S. Cl.
CPC ..... *G10D 13/02* (2013.01)

(58) Field of Classification Search
CPC ..... G10D 13/02; G10D 13/026
See application file for complete search history.

(56) References Cited

U.S. PATENT DOCUMENTS 2,615,662 A * 10/1952 Sannebeck ..... G10D 13/026 248/124.2
3,704,645 A * 12/1972 Grauso ..... G10D 13/026 84/421
3,955,465 A * 5/1976 Zickos ..... G10D 13/02 84/411 R
4,185,808 A * 1/1980 Donohoe ..... G10D 13/00 248/295.11
4,279,189 A * 7/1981 Kelly ..... G10D 13/026 84/421
4,593,596 A * 6/1986 Gauger ..... G10D 13/026 84/421
7,087,825 B2 * 8/2006 Izen ..... G10D 13/026 248/295.11
7,528,312 B1 * 5/2009 DiGiovanni ..... G10D 13/02 84/411 R
8,865,987 B2 * 10/2014 Mori ..... G10D 13/02 84/415

(Continued)

OTHER PUBLICATIONS

Pearl Corporation, "Pearl Compact Traveller," Pearl The Best Reason to Play Drums, https://pearldrum.com/products/kits/drumsets/compact-traveler/.

(Continued)

*Primary Examiner* — Robert W Horn
(74) *Attorney, Agent, or Firm* — Ferguson Case Orr Paterson

(57) ABSTRACT

A transportable drum kit and components thereof are disclosed. The kit can include a stand that is connected to a bass drum, the stand having two legs that can provide support to the bass drum. The two legs can fold into a cavity of the bass drum. The kit can include a second drum supported by a leg. The two stand legs and the second drum leg can be on opposite sides of said bass drum so as to provide for triangulated support of the bass drum, resulting in less sound distortion than a bass drum that supports its own weight.

20 Claims, 8 Drawing Sheets

(56) References Cited

U.S. PATENT DOCUMENTS

| | | | | |
|---|---|---|---|---|
| 10,163,426 | B2 * | 12/2018 | Yoshino | G10D 13/00 |
| 2015/0082967 | A1 * | 3/2015 | Yoshino | G10D 13/022 84/411 M |
| 2015/0345529 | A1 * | 12/2015 | Slaton | F16B 7/0486 84/421 |
| 2018/0330700 | A1 * | 11/2018 | Bardin | A47C 9/08 |
| 2019/0228747 | A1 * | 7/2019 | Sikra | G10D 13/026 |
| 2019/0371285 | A1 * | 12/2019 | Fowler | G10D 13/026 |

OTHER PUBLICATIONS

Guitar Center, "Pearl Rhythm Traveller," https://www.guitarcenter.conn/Pearl/Rhythm-Traveller-5-Piece-Drum-Set.

Reverb.com, LLC, "Percussion Rims 6pc Drum Kit With Bag" https://reverb.com/item/4683653-c-purecussion-rims-6pc-drum-kit-w-bag (1993).

Reverb.com, LLC, "Sonor Pancake Snare Drum 1960's Metal" https://reverb.com/item/2750364-sonor-pancake-snare-drum-1960-s-metal (1970).

Traps Drums, "Acoustic Range A300NC" Alchemy Engineering Design Ltd. https://www.trapsdrums.com/traps-products-page/acoustic-range/a300nc/ (2014).

Traps Drums, "Acoustic Range A400NC" Alchemy Engineering Design Ltd. https://www.trapsdrums.com/traps-products-page/acoustic-range/a400nc/ (2014).

Traps Drums, "Acoustic Range EX300" Alchemy Engineering Design Ltd. https://www.trapsdrums.conn/traps-products-page/electronic-range/ex300/ (2014).

Traps Drums, "Acoustic Range EX400" Alchemy Engineering Design Ltd. https://www.trapsdrums.conn/traps-products-page/electronic-range/ex400/ (2014).

Traps Drums, "Acoustic Range EX500" Alchemy Engineering Design Ltd. https://www.trapsdrums.com/traps-products-page/electronic-range/ex500/ (2014).

Treehouse Drums, "Compact Nesting Kits—TreeHouse Custom Drums" SuperSonic Music https://www.treehousedrums.com/compact-configurations.html.

* cited by examiner

TRANSPORTABLE DRUM KIT

RELATED APPLICATION

The present application claims the priority benefit of U.S. Provisional Patent App. No. 62/621,568 to Sikra, filed on Jan. 24, 2018 and entitled "Transportable Drum Kit," the entire contents of which are incorporated by reference herein.

BACKGROUND OF THE DISCLOSURE

Field of the Disclosure

Aspects of the present disclosure generally relate to percussion instruments, and more specifically, the present disclosure relates to relatively compact and/or compactible percussion systems such as drum kits.

Description of the Related Art

Musical notes have been created using many forms of instruments and devices. Percussion instruments, i.e., those that generate sound by being beaten, rattled, and/or vibrated, are sometimes considered to be the oldest type of musical instrument. There are many types of percussion instruments, the drum being one classic example.

Drum kits or sets typically comprise multiple percussion instruments, such as a bass drum, snare drum, toms, hi-hat, and/or additional cymbals assemblies, to name a few.

Percussionists often need to perform in various locations requiring transportation of percussion instruments, such as drum kits. Standard, full size, non-compactible drum kits are often bulky and difficult to move, and require significant labor in assembling and disassembling. Some drum kits designed for easier transportation still present the above problems while also failing to provide a high-quality performance.

BRIEF DESCRIPTION OF THE DRAWINGS

For a more complete understanding of the present disclosure, reference is now made to the following description taken in conjunction with the accompanying drawings.

DETAILED DESCRIPTION OF THE DISCLOSURE

Figure 1:
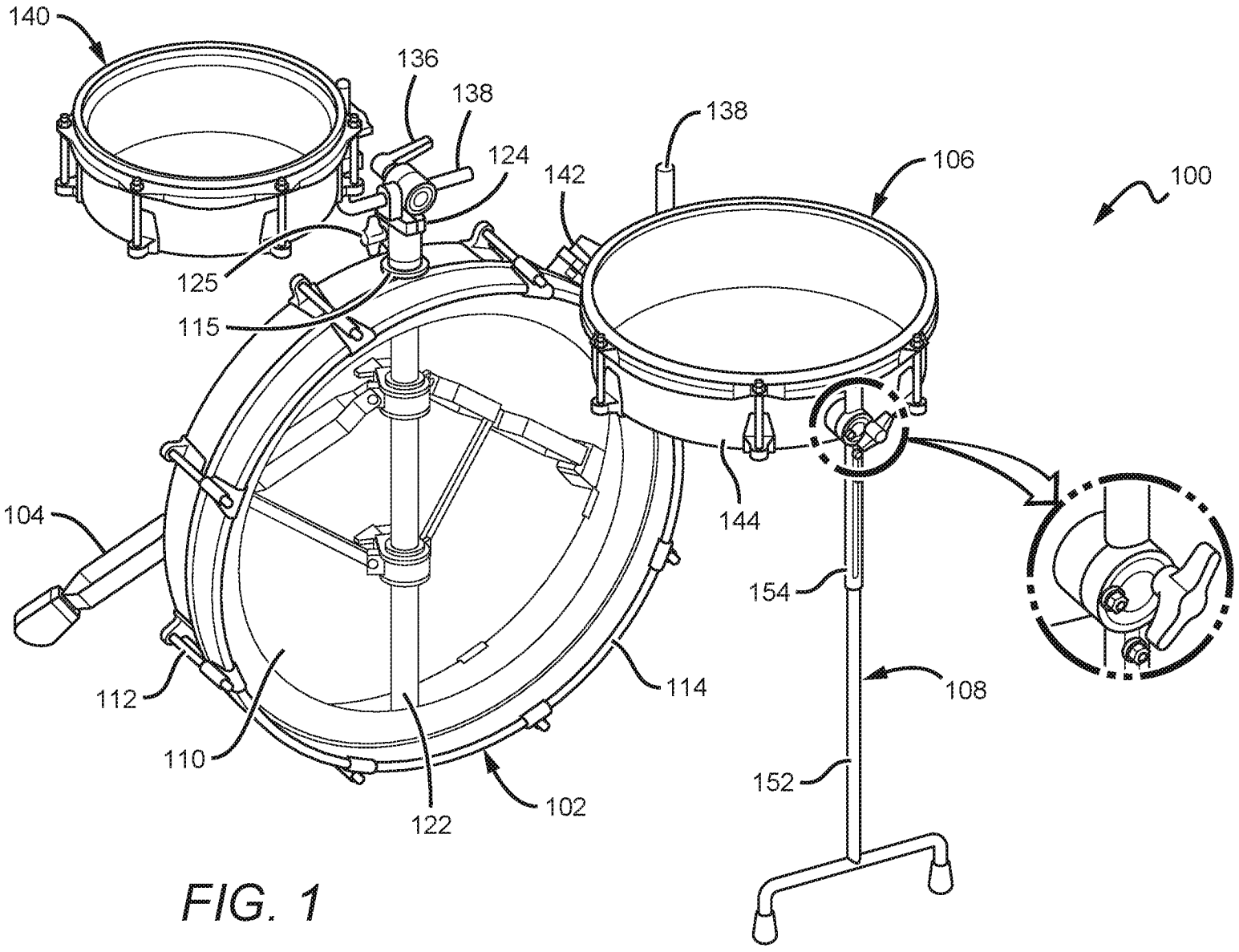
FIG. 1 shows a front perspective view of a transportable drum kit according to one embodiment of the present disclosure.

Embodiments of the present disclosure include transportable drum kits and their components, such as a bass drum with an integrated stand, a floor tom leg, a snare, and claw hook lugs. The transportable drum kit is light, easily assembled and disassembled, and compact, allowing for convenient storage and transportation. The transportable drum kit can include a bass drum with a bass drum stand, a floor tom that attaches to the bass drum and a floor tom leg, one or more rack toms and/or snare drums such as rack toms and/or snare drums attached to the bass drum stand, and/or other components. The floor tom could be replaced, for example, with a floor snare drum.

In the bass drum's erect position, the stand extends through the top portion of the bass drum shell. The bass drum stand has one, two, three, four, or more collapsible legs that protrude away from the bass drum to stabilize the main body of the bass drum and any other components of the transportable drum kit attached thereto. The legs can fold at least partially within the cavity formed by the bass drum shell and head so that the stand does not substantially extend beyond the bass drum shell when compacted. One or more rack toms can attach to a portion of the bass drum stand extending through the top of the bass drum (such as through the bass drum shell).

A floor tom can attach to the bass drum, such as to the shell thereof, and to a floor tom leg, such that the floor tom is positioned between the bass drum and the floor tom leg. The floor tom leg creates additional structural stability for the drum kit as a whole by acting as one or more legs in addition to the bass drum stand legs, thus stabilizing the bass drum and any other components attached thereto. The floor tom leg comprises an upper portion and a lower portion that telescopically fits at least partially within the upper portion. The floor tom leg is adjustable in height by altering the amount that the lower portion is within the upper portion, allowing the floor tom's height to also adjust without causing the floor tom leg to rise above the floor tom and obstruct the percussionist's access to the floor tom. In some embodiments, the upper portion telescopically fits at least partially within the lower portion, and the height of the floor tom leg is adjustable by altering the amount that the upper portion is within the lower portion.

With the bass drum stand often including two legs on one side of the bass drum, and the floor tom leg including one or more legs on the other side of the base drum, a triangulated (or more) support system is formed with the bass drum between the supports, resulting in the weight of the system being held by the supports instead of by the bass drum itself, and resulting in a more stable system overall.

In some embodiments, the transportable drum kit comprises a snare drum. The snare drum can comprise a snare strainer with a drum key screw that passes through a tensioning component and extends through an oval-shaped opening in the snare drum shell. The tensioning component comprises an oblong-shapes protrusion to fit securely in the opening in the snare drum shell and prevent the drum key screw from unwanted loosening. It is understood that the snare drum could substitute for any of the toms discussed above.

The drum shells are comprised of wood, which provides a rich and full sound to the drums. Other materials are possible. In some embodiments, the drum shells can be comprised of one or a combination of materials known within the art including, but not limited to, wood composite and polymers such as plastic.

The drums can include claw hook lugs with a slanted edge angled approximately 45 degrees in relation to the adjoining surfaces. The slanted edge is positioned to fit on the bottom inner edge of the drum shells to prevent the shells from being pulled outward by the force exerted from the tension rods used to mount heads to the shells, as shells often are when using lugs with all right angles. The claw hook lugs can be utilized with any drum, including but not limited to the bass drum, the floor tom, the rack toms, a snare, etc. Additional features and advantages of the disclosure will be described below. It should be appreciated by those skilled in the art that this disclosure may be readily utilized as a basis for modifying or designing other structures for carrying out the same or similar purposes of the present disclosure. It should also be realized by those skilled in the art that such equivalent constructions do not depart from the teachings of the disclosure. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those reasonably skilled in the art that these concepts may be practiced without these specific details. In some instances, structures and components are shown in block diagram form in order to aid in avoiding obscuring such concepts.

It is understood that when an element is referred to as being "on," "attached to," "connected to," or similar to another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

Figure 2:
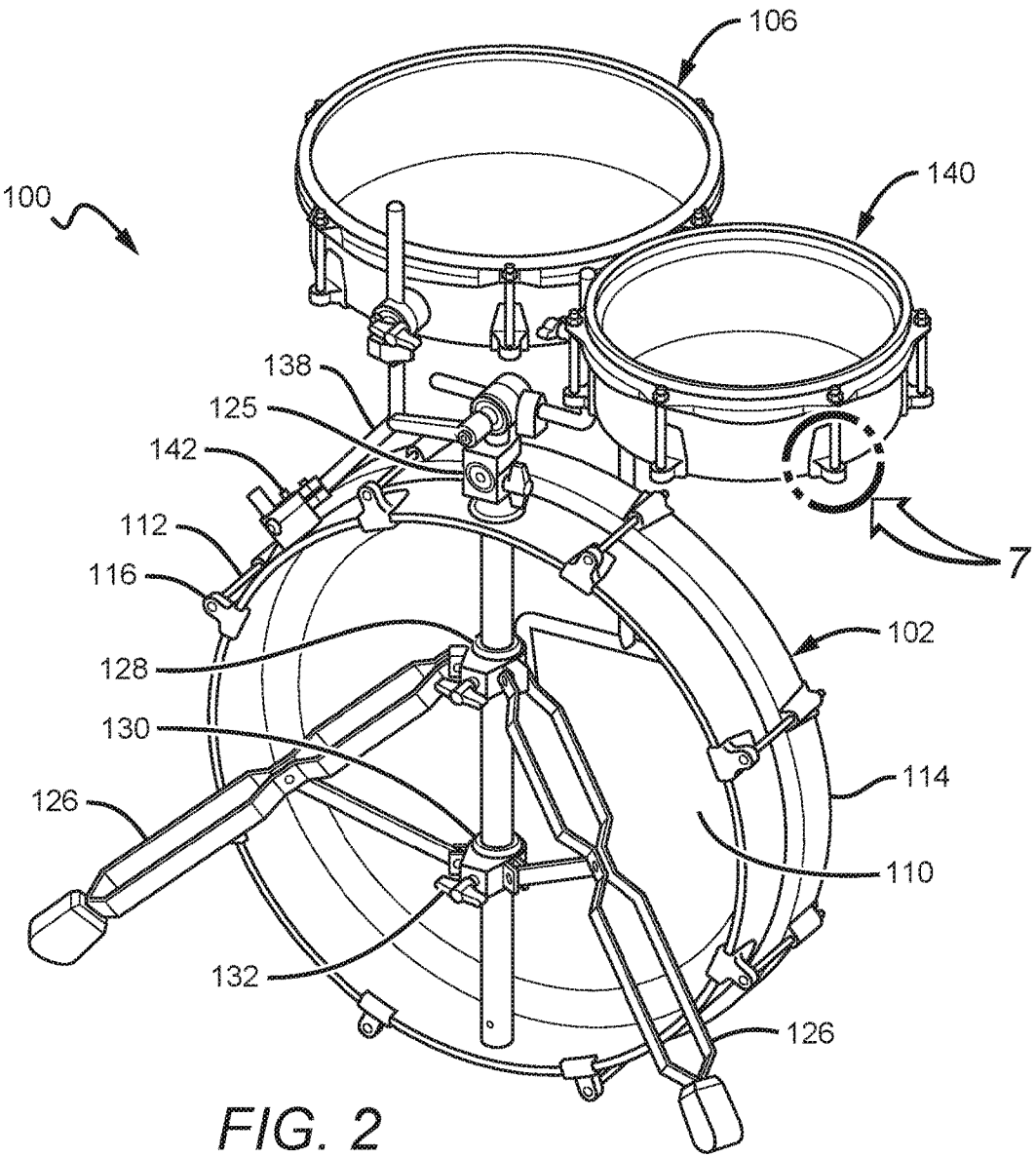
FIG. 2 shows a rear perspective view of the transportable drum kit shown in FIG. 1.

FIGS. 1-2 illustrate one embodiment of a transportable drum kit 100 according to the present disclosure. The transportable drum kit 100 comprises a bass drum 102 with an integrated stand 104, a floor tom 106, and a floor tom leg 108 (though it is understood that a different style of drum such as a snare drum could substitute for the floor tom 106). The bass drum 102 has a single head 110 and an open back, with the bass drum shell 114 and head 110 forming a cavity therebetween in the back of the bass drum 102. The tension rods 112 along the bass drum shell 114 each couple to a claw hook lug 116, which couples to the rear edge of the bass drum shell 114. The bass drum shell 114 contains a hole at the top fitted with a rubber grommet 115 through which the stand 104 extends. The rubber grommet 115 allows for the stand 104 to securely fit through the hole in the bass drum shell 114 while not significantly reducing the sound quality of the bass drum 102.

Figure 4:
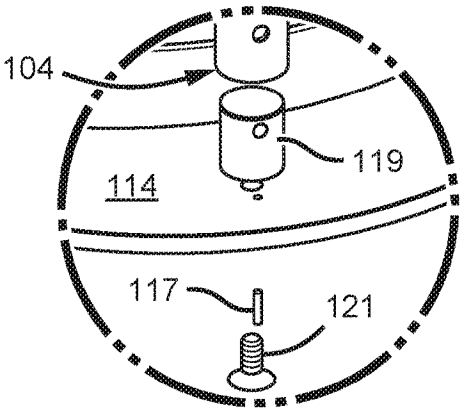
FIG. 4 shows a close-up view of part of the bass drum according to the embodiment shown in FIG. 1.
Figure 3:
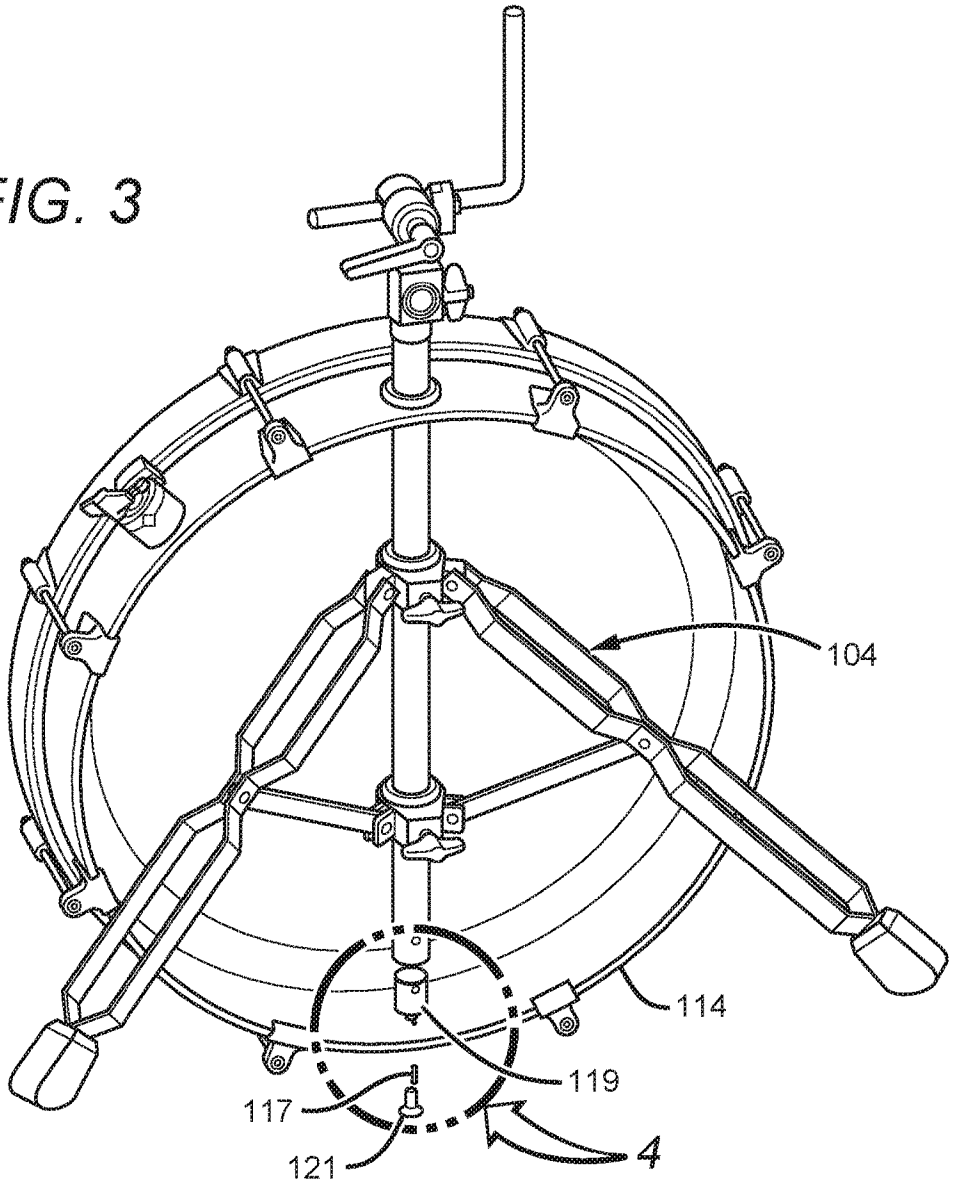
FIG. 3 shows a rear view of the bass drum according to the embodiment shown in FIG. 1.

As shown in FIGS. 3-4, the end of the stand 104 rests on the bottom of the inner surface of the bass drum shell 114. A metal roll pin 117 is inserted through the bottom of the bass drum shell 114 and off-center into a metal plug 119 that closely fits within the stand 104. The metal plug 119 can be approximately one inch in diameter and approximately one inch in height. In other embodiments, the metal plug 119 can be of different dimensions that also create a close fit within the stand 104. A screw 121, such as a flat head screw, passes through the bottom of the bass drum shell 114 near the metal roll pin 117 and into the center of a metal plug 117 such that the head of the screw 121 covers the metal roll pin 117 and secures it in position. The metal roll pin 117 being off-center in the metal plug 119 prevents the metal plug 119 and the stand 104 from spinning. The stand 104 and the metal plug 119 can have aligning holes in their sides. In some embodiments, a pin or screw can be inserted into the aligning holes for further stability and insurance that the stand 104 does not spin. In some embodiments, the metal roll pin 117 fits off-center into the stand 104 instead of the metal plug 119 to prevent the stand 104 from spinning.

In some embodiments, the bass drum shell 114 can contain a hole or indent in which the bottom of the stand 104 can rest. In some embodiments, the stand 104 extends through a bottom hole, which can be fitted with a rubber grommet similar to the rubber grommet 115 at the top of the bass drum shell 114. In some embodiments, the stand 104 is only attached to the bass drum 102 at the top of the bass drum shell 114. In some embodiments, the stand 104 is only attached to the bass drum 102 at the bottom of the bass drum shell 114. In some embodiments, the stand 104 is floating and not fixed to the bass drum 102 such that it can move vertically.

The stand 104 comprises a lower tube 122 and an upper tube 124. The upper tube 124 has a smaller cross section than the lower tube 122 and can slide in and out of the lower tube 122 telescopically to adjust the height of the stand 104 by tightening or loosening the height adjustment bracket 125. The position of the upper tube 124 in relation to the lower tube 122 can be maintained by tightening the height adjustment bracket 125. In some embodiments, the lower tube 122 has a smaller cross section than the upper tube 124 and can slide in and out of the upper tube 124 telescopically.

Figure 5:
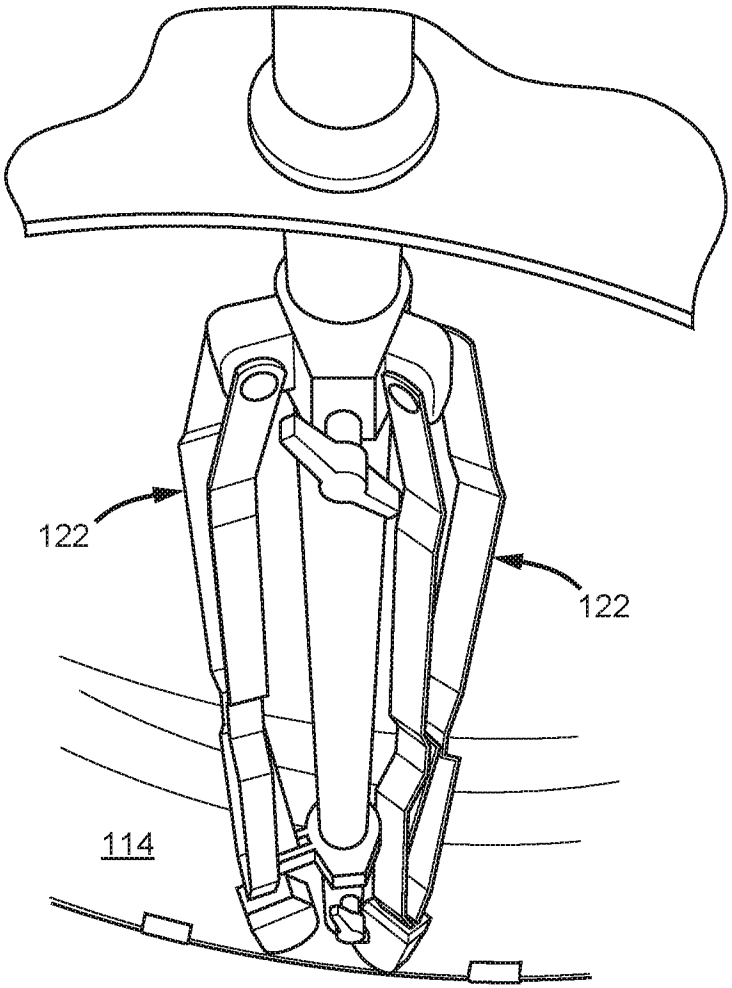
FIG. 5 shows a top perspective view of part of the bass drum according to the embodiment shown in FIG. 1.

As shown in FIGS. 1-2, the stand 104 comprises two stand legs 126. Having two stand legs can provide the advantage of, in combination with only a single leg on the other side of the bass drum, providing a triangular support. In some embodiments the stand 104 can comprise one stand leg 126. In some embodiments the stand 104 can comprise three or four stand legs 126. In some embodiments the stand 104 can comprise five or more stand legs 126. The stand legs 126 connect to the lower tube 122 by upper and lower brackets 128,130, which can slide along the lower tube 122. The upper and lower brackets 128,130 can tighten at a desired position along the lower tube 122 by wing bolts 132 or various types of tightening mechanisms known within the art. The stand legs 122 provide structural support, specifically at the rear of the transportable drum kit 100. For storing or transporting, the stand legs 122 can fold toward the lower tube 122 such that the stand legs 122 are approximately parallel with the lower tube 112 and are within or approximately within the bass drum shell 114 (shown in FIG. 5).

The distal end of the upper tube 124 comprises a base connector bracket 136 than can hold one or more tom L-arms 138. FIGS. 1-2 show the base connector bracket 136 holding the tom L-arm 138 of a rack tom 140. The bass drum shell 114 can have a floor tom connector 142 that attaches to a tom L-arm 138 attached to the floor tom shell 144. The opposite side of the floor tom shell 144 connects to the floor tom leg 108, such that the floor tom 106 is between the floor tom connector 142 and the floor tom leg 108. Though shown as opposite the floor tom connector 142 in this embodiment, the floor tom leg 108 need not be exactly opposite or opposite the floor tom connector 142, but in other embodiments can be at other radial points.

The floor tom leg 108 creates additional structural stability to the transportable drum kit by acting as one or more legs for the transportable drum kit in addition to the stand legs 126. The two stand legs 126 and the floor tom leg 108 create a triangulated supportive structure. The stand legs 126 and the floor tom leg 108 support a substantial amount of the weight of the transportable drum kit 100 and minimize the amount of weight supported by the bass drum 102. As a result, any sound dampening due to weight on the bass drum 102 is minimal. As shown in FIGS. 1-2, the floor tom leg 108 has two feet 151. In some embodiments, the floor tom leg 108 can have only one foot 151. In other embodiments, the floor tom leg 108 can have three or more feet 151. In some embodiments, the feet 151 can be foldable. In some embodiments, multiple feet 151 can extend radially from the floor tom leg 108 or there can be two or more floor tom legs 108, providing additional structural support and triangulation support for embodiments wherein the stand 104 only has one stand leg 126.

The floor tom leg 108 comprises a lower portion 152 and an upper portion 154. The lower portion 152 has a smaller cross section than the upper portion 154 and can slide in and out of the upper portion telescopically to adjust the height of the floor tom leg 108. In some embodiments, the upper portion 154 has a smaller cross section than the lower portion 152 and can slide in and out of the lower portion telescopically. Leg screws 156 tighten the lower portion 152 and the upper portion 154 together to remain fixed at a desired position. Other securing mechanisms known within the field can also be used instead of leg screws 156 including, but not limited to, release levers. The floor tom leg 108 allows the height of the floor tom 106 to adjust without causing the floor tom leg 108 from rising above the floor tom 106 and interfering with the percussionist's access to the floor tom 106. The floor tom leg 108 can be shortened for storage and transportation.

Figure 6:
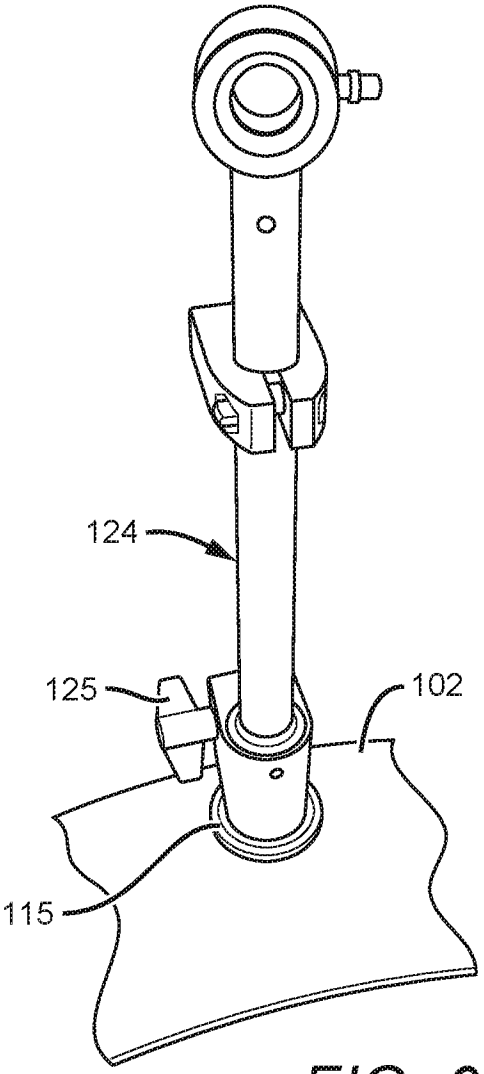
FIG. 6 shows another top perspective view of part of the bass drum according to the embodiment shown in FIG. 1.

FIG. 6 shows the rubber grommet 115 in the bass drum 102 and an extended upper tube 124 tightened by the height adjustment bracket 125, which allows for one or more rack toms to be raised to a higher position.

Figure 7:
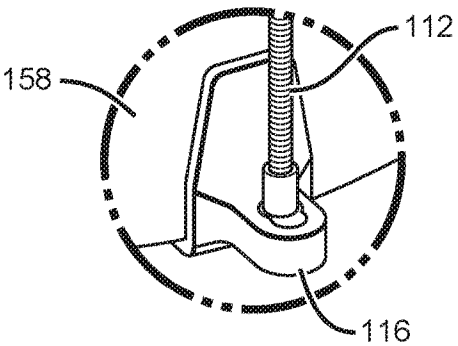
FIG. 7 shows a close-up view of a lug according to the embodiment shown in FIG. 1.
Figure 8:
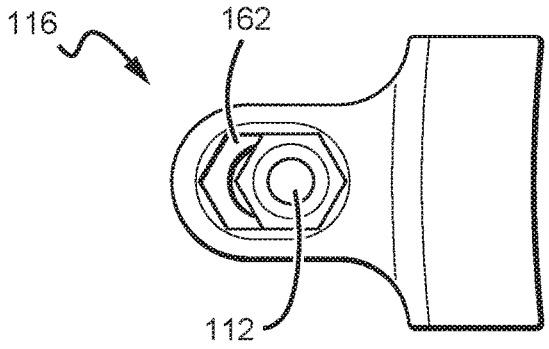
FIG. 8 shows a bottom view of the lug according to the embodiment shown in FIGS. 1 and 7.
Figure 9:
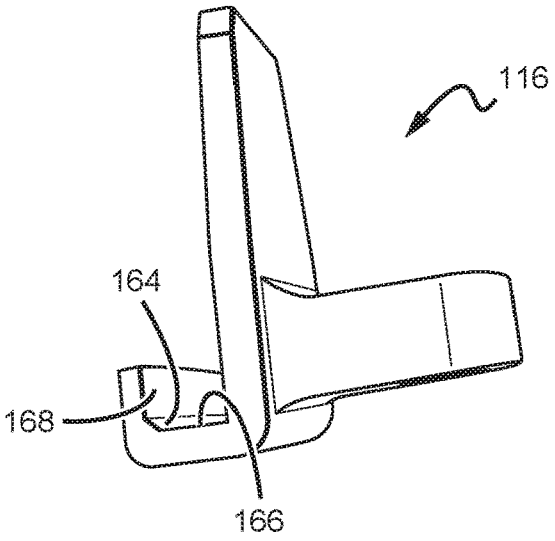
FIG. 9 shows a side view of the lug according to the embodiment shown in FIGS. 1 and 7.

FIGS. 7-9 show close-up views of the claw hook lug 116. The claw hook lug can be used in place of and/or in addition to regular lugs as known in the art, and in the specific embodiment of FIG. 7 is on the bottom edge of the rack tom shell 158. As shown in FIG. 8, the lug hole 162 is oversized to allow for the tension rod 112 to float and self-adjust in the claw hook lug 116. The lug hole 162 is shaped to receive a hexagonal screw and is elongated in a direction normal to the drum shell 158 surface. With prior art lugs, a tension rod can often be angled in an undesirable way (and cause undesired pressure on other parts of the drum) due to the difference in diameter between the drum's hoop/rim and its shell. The elongated lug hole 162 allows the tension rod 112 to self-adjust so as to correct this improper angle. As a result, the same claw hook lug 116 universally fits all of the drums in transportable drum kit 100, despite those different drums having varying differences in hoop diameter and shell diameter (which in the prior art, would have required differently sized lugs to be properly angled). In some embodiments the lug hole 162 can be oval shaped, rectangular, elongated octagonal, or other shapes.

FIG. 9 shows a perspective side view of the claw hook lug 116 comprising a slanted edge 164 at approximately a 135 degree angle in relation to the inner bottom surface 166 and the inner side surface 168 of the claw hook lug 116. The slanted edge 164 has an approximately flat surface. The slanted edge 164 prevents the drum shell 158 from being pulled outward toward the tension rod 112 when the tension rod 112 is tightened on the drum shell 158. As the slanted edge 164 is raised compared to the inner bottom surface 166, more pressure is applied to the inner part of the drum shell's edge than the outer part of the drum shell's edge, which encourages the edge of the drum shell 158 inward, thus countering the partial outward force applied to the edge of the drum shell by the tension rod 112. In some embodiments, the slanted edge 164 can be approximately 100 to 135 degrees in relation to the inner bottom surface 166. In some embodiments, the slanted edge 164 can be approximately 135 to 170 degrees in relation to the inner bottom surface 166. In some embodiments, the slanted edge 164 can be approximately 100 to 170 degrees. In some embodiments, the slanted edge can be approximately 120 to 150 degrees. In some embodiments, the surface of the slanted edge 164 is curved. Many different embodiments are possible.

Figure 10:
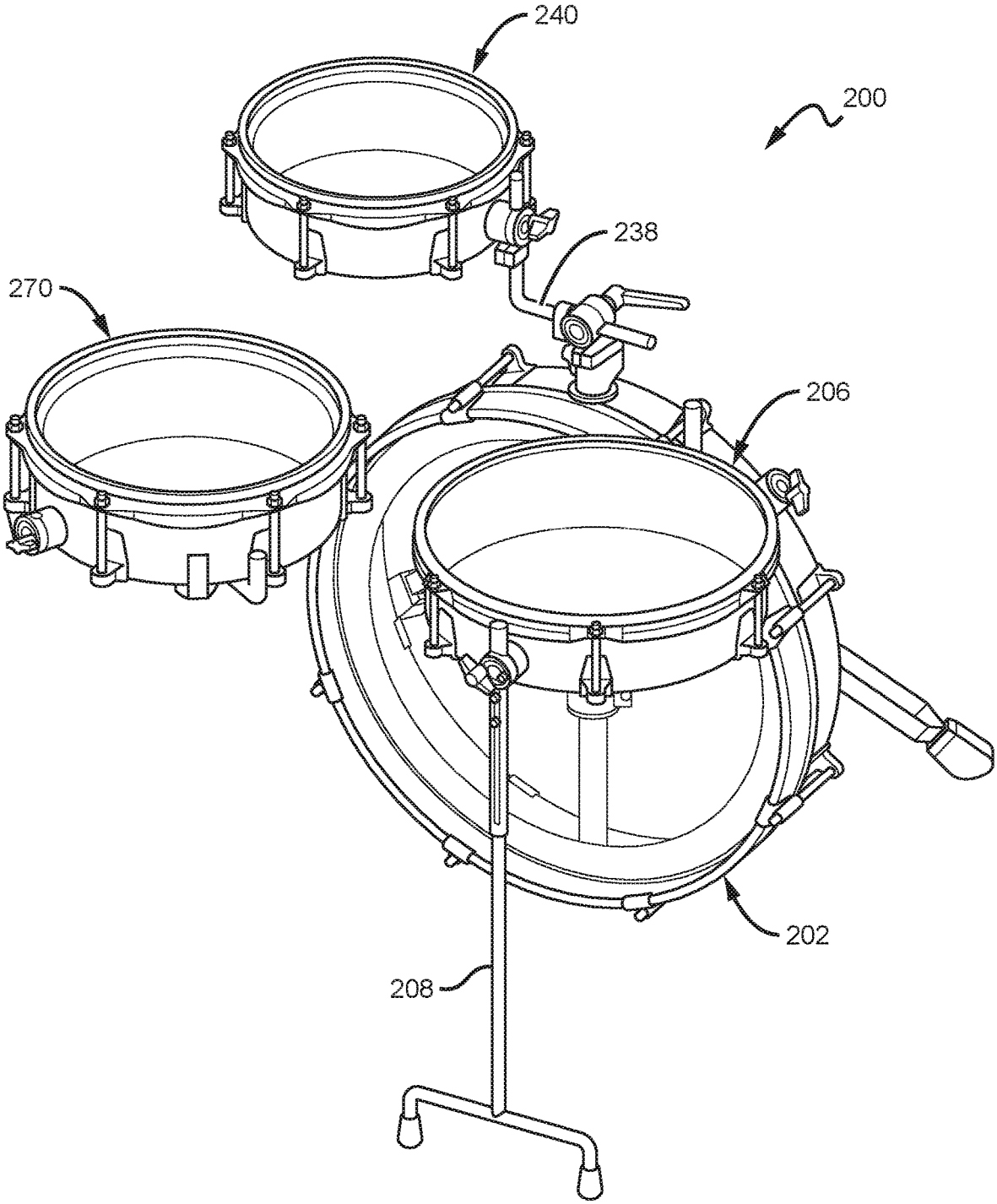
FIG. 10 shows a front perspective view of a transportable drum kit according to one embodiment of the present disclosure.
Figure 11:
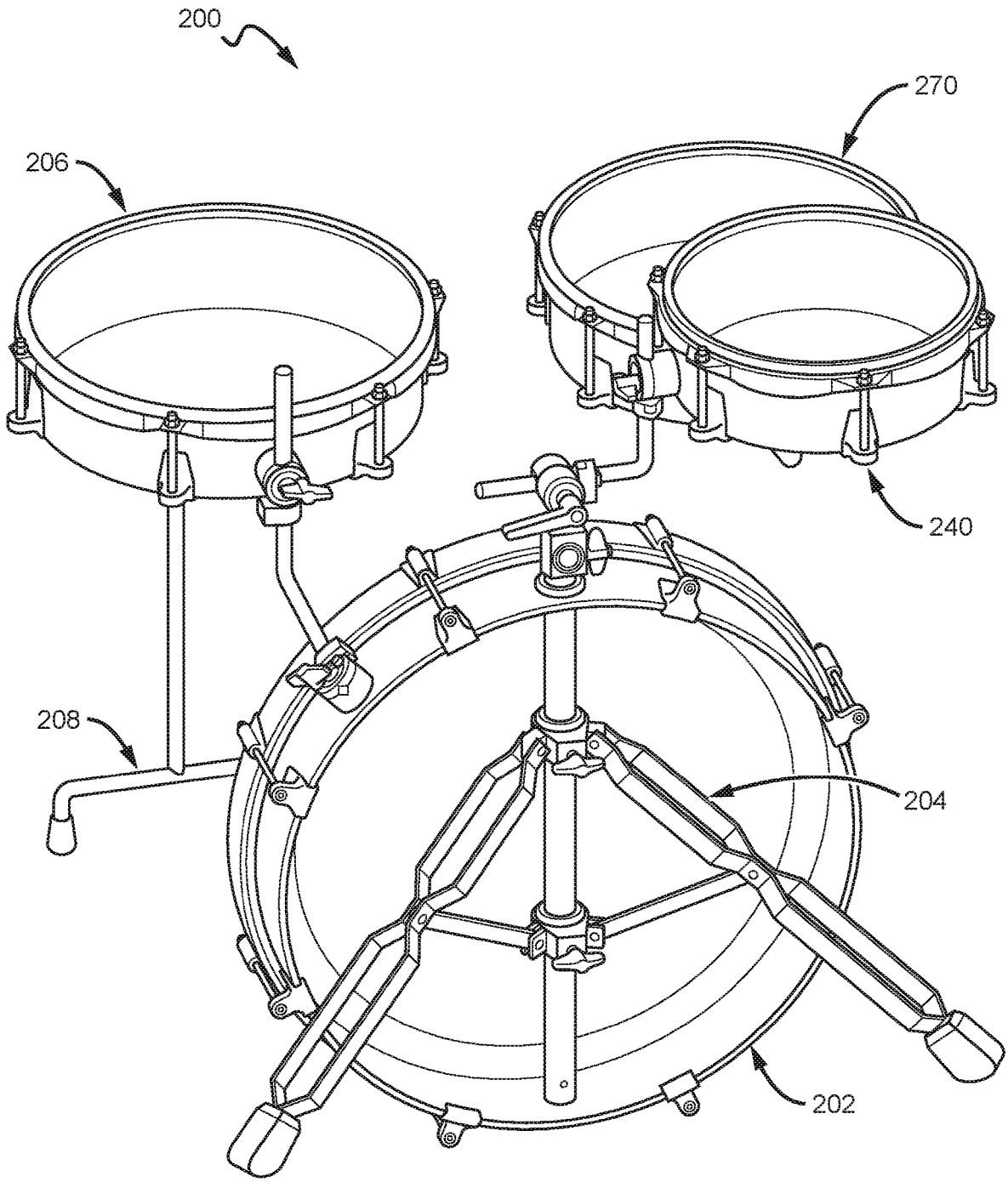
FIG. 11 shows a rear perspective view of the transportable drum kit shown in FIG. 10.

FIGS. 10-11 show another embodiment of the transportable drum kit 200. Similar to the transportable drum kit 100, this embodiment comprises a bass drum 202 with an integrated stand 204, a floor tom 206, a floor tom leg 208, and a rack tom 240. In addition, the transportable drum kit 200 also comprises a snare drum 270. The snare drum is separate from the bass drum 202 and has its own stand (not shown). In some embodiments, the snare drum is attached to an L-arm that attaches to the bass drum in a manner similar to the floor tom 206. In some embodiments, the snare drum 270 can have a floor leg similar to the floor tom leg 208. In some embodiments, the snare drum 270 can be used in place of the rack tom 240.

In some embodiments, the snare drum 270 can be used as a second rack tom. In this mode, an L-arm attached to the snare drum 270 attaches to the tom L-arm 238 of the rack tom 240 with another bracket (not shown). An additional snare drum can then be used as a snare drum in conjunction with the rack tom 240, the snare drum 270 now replacing the second rack tom, the bass drum 202, and the floor tom 206.

Figure 12:
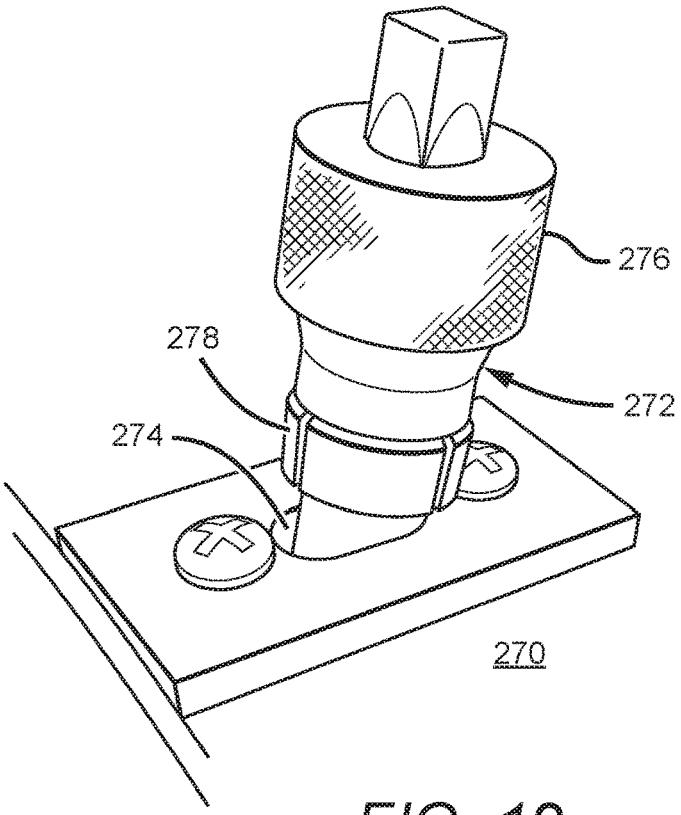
FIG. 12 shows a close-up side view of a snare drum according to the embodiment shown in FIG. 10.
Figure 13:
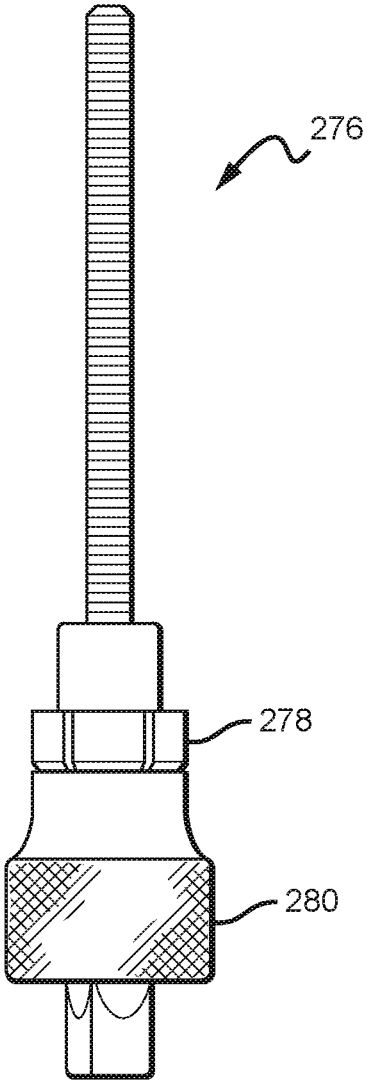
FIG. 13 shows components of the snare drum according to the embodiment shown in FIG. 10.
Figure 14:
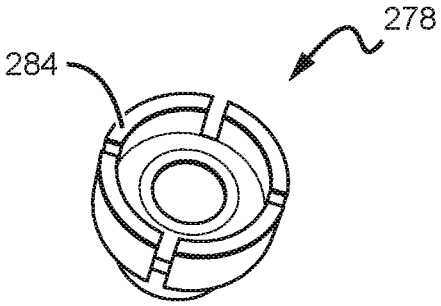
FIG. 14 shows a top perspective view of a component of the snare drum according to the embodiment shown in FIG. 10.
Figure 15:
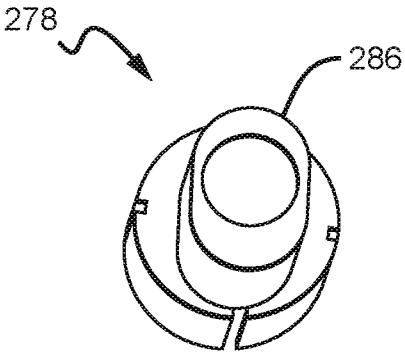
FIG. 15 shows a bottom perspective view of a component of the snare drum according to the embodiment shown in FIGS. 10 and 14.

FIG. 12 shows a close-up side view of the snare drum 270 comprising a snare strainer 272. The snare drum 270 comprises an elongated snare hole 274 to receive the snare strainer 272. The snare strainer 272 comprises a drum key screw 276 that passes through a tensioning component 278. FIG. 13 shows the drum key screw 276 and tensioning component 278 of the drum key screw 276. FIGS. 14-15 show the top and bottom sides of the tensioning component 278, respectively. As shown in FIG. 13, the drum key screw head 280 partially rests inside the top side of the tensioning component 278. The top side of the tensioning component 278 has a lip 284 forming an opening for part of the drum key screw head to tightly fit within. The remainder of the drum key screw 276 passes through the tensioning component 278 to connect with the rest of the snare strainer 272.

The bottom side of the tensioning component 278 has an oblong protrusion 286 that fits into the snare hole 274 such that the tensioning component 278 is unable to turn within the snare hole 274. As the tensioning component 278 is fitted tightly on the drum key screw 276, additional force is required to turn the drum key screw 276 than if the snare strainer 272 did not have the tensioning component 278. The tensioning component 278, therefore, prevents unwanted loosening of the drum key screw 276 and the snare strainer 272.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a device. Of course, if the device is inverted, above becomes below, and vice versa. Additionally, if oriented sideways, above and below may refer to sides of a device. Moreover, the scope of the present application is not intended to be limited to the particular configurations of the process, machine, manufacture, composition of matter, means, methods and steps described in the specification. As one of ordinary skill will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure.

The description of the disclosure is provided to enable any person of reasonable skill to make or use the disclosure. Various modifications to the disclosure will be readily apparent to those of reasonable skilled, and the generic principles defined herein may be applied to other variations without departing from the spirit or scope of the disclosure. Features from different embodiments can be combined unless specifically stated otherwise. Thus, the disclosure is not intended to be limited to the examples and designs described herein but is to be accorded the widest scope consistent with the principles and novel features disclosed herein.

I claim:

1. A drum set, comprising:

a bass drum;

a stand attached to said bass drum, said stand comprising a rod through a shell of said bass drum and behind a head of said bass drum, and further comprising two bass drum legs extending from said rod;

a second drum connected to said bass drum and in front of said bass drum; and a third leg extending downward from said second drum.

2. The drum set of claim 1, wherein said third leg has an adjustable height.

3. The drum set of claim 2, wherein said third leg is a telescoping leg.

4. The drum set of claim 1, wherein said third leg comprises two or more feet.

5. The drum set of claim 1, wherein said second drum is connected to said bass drum by a second rod.

6. The drum set of claim 1, wherein said two bass drum legs can fold toward said rod so as to be substantially within a cavity formed by said shell of said bass drum and said head of said bass drum.

7. The drum set of claim 1, wherein said rod is through said shell of said bass drum at two annularly opposite points.

8. The drum set of claim 1, further comprising a third drum connected to said bass drum by an L-arm.

9. A percussion instrument, comprising:

a bass drum; and a stand attached to said bass drum, said stand comprising a rod through a shell of said bass drum and behind a head of said bass drum, and further comprising two bass drum legs extending from said rod;

wherein said two bass drum legs can fold toward said rod so as to be substantially within a cavity formed by said shell of said bass drum and said head of said bass drum.

10. The percussion instrument of claim 9, wherein said rod is through said shell of said bass drum at two annularly opposite points.

11. The percussion instrument of claim 9, further comprising a grommet where said rod is through said shell of said bass drum.

12. The percussion instrument of claim 9, wherein said rod abuts an inside of said shell of said bass drum at a point annularly opposite where said rod is through said shell of said bass drum.

13. The percussion instrument of claim 9, further comprising an L-arm connected to said shell of said bass drum for connection of a second drum to said bass drum.

14. A hook lug for connection to a tensioning rod and a drum shell, said hook lug comprising:

a main body comprising a substantially vertical body portion and a substantially horizontal body portion, and further comprising an angled portion between said substantially vertical and substantially horizontal body portions; and a connection portion extending outward from said main body.

15. The hook lug of claim 14, wherein said connection portion defines an oversized lug hole to allow for self-adjustment of a tensioning rod.

16. The hook lug of claim 14, wherein said connection portion defines an elongated lug hole to allow for self-adjustment of a tensioning rod.

17. The hook lug of claim 14, wherein said angled portion forms an angle of between 100° and 170° with said substantially horizontal body portion.

18. The hook lug of claim 14, wherein said angled portion forms an angle of between 120° and 150° with said substantially horizontal body portion.

19. The hook lug of claim 14, wherein said angled portion forms an angle of approximately 135° with said substantially horizontal body portion.

20. The hook lug of claim 14, wherein said main body further comprises a second substantially vertical body portion connected to said substantially horizontal portion, said connection portion extending outward from said second substantially vertical body portion.

* * * * *